United States Patent [19]

Rochas et al.

[11] Patent Number: 4,780,585

[45] Date of Patent: Oct. 25, 1988

[54] METHOD AND DEVICE FOR THE THERMAL TREATMENT OF A CONDUCTOR ELEMENT AT LEAST PARTIALLY CONSTITUTED BY A CONDUCTING MATERIAL

[75] Inventors: Jean-Francois Rochas, Lyon Croix-Rousse; Bertrand Lapoulle, Saint-Etienne; Jean-Michel Tremillon, Pau; Francis Gensous, Lons par Billere, all of France

[73] Assignees: Societe Nationale Elf Aquitaine, Paris; Institut Textile de France, Boulogne Billancourt Cedex, both of France

[21] Appl. No.: 31,558

[22] PCT Filed: Jun. 26, 1986

[86] PCT No.: PCT/FR86/00226

§ 371 Date: Feb. 26, 1987

§ 102(e) Date: Feb. 26, 1987

[87] PCT Pub. No.: WO87/00387

PCT Pub. Date: Jan. 15, 1987

[30] Foreign Application Priority Data

Jun. 28, 1985 [FR] France ..... 85 09877

[51] Int. Cl.[4] ..... H05B 6/78

[52] U.S. Cl. ..... 219/10.55 A; 219/10.55 M; 219/10.55 F; 219/10.61 R; 219/10.75

[58] Field of Search ..... 219/10.55 M, 10.55 A, 219/10.55 B, 10.55 R, 10.55 F, 10.55 D, 10.61 R, 10.41, 10.43, 10.75, 10.81; 34/1

[56] References Cited

U.S. PATENT DOCUMENTS

| | | | |
|---|---|---|---|
| 2,640,142 | 5/1953 | Kinn | 219/10.61 R |
| 3,320,396 | 5/1967 | Boehm | 219/10.55 B |
| 3,452,176 | 6/1969 | Levinson | 219/10.61 |
| 3,461,261 | 8/1969 | Lewis et al. | 219/10.55 A |
| 3,553,413 | 1/1971 | Soulier | 219/10.61 R |
| 3,571,551 | 3/1971 | Ogasawara | 219/10.55 A |
| 3,590,202 | 6/1971 | Day et al. | 219/10.61 R |
| 4,186,044 | 1/1980 | Bradley et al. | 219/10.55 A |

FOREIGN PATENT DOCUMENTS

| | | |
|---|---|---|
| 959008 | 3/1950 | France . |
| 1532710 | 7/1968 | France . |
| 1092861 | 11/1967 | United Kingdom . |

*Primary Examiner*—Philip H. Leung

*Attorney, Agent, or Firm*—Burgess, Ryan and Wayne

[57] ABSTRACT

An alternating current with a frequency comprised between 1 MHz and 10 GHz is generated in a portion of the conductor element (38) limited by two short circuits (12, 13), thereby causing a heating by Joule effect of said conductor element portion. To generate said current, the electromagnetic energy emitted by the microwave or high-frequency generator (1) emitting at the selected frequency is electrically or magnetically coupled by means of an applicator (2, 7) to the conductor element portion acting as antenna tuned on the emission frequency of the generator (1). Application, among other things, to the homogeneous coating of a conductor element, for example based on carbon fibres, carrying a continuous element, for example based on carbon fibres, carrying a continuous or discontinuous coating of thermoplastic material susceptible of heating and melting by thermal conduction.

41 Claims, 3 Drawing Sheets

Figure 1:
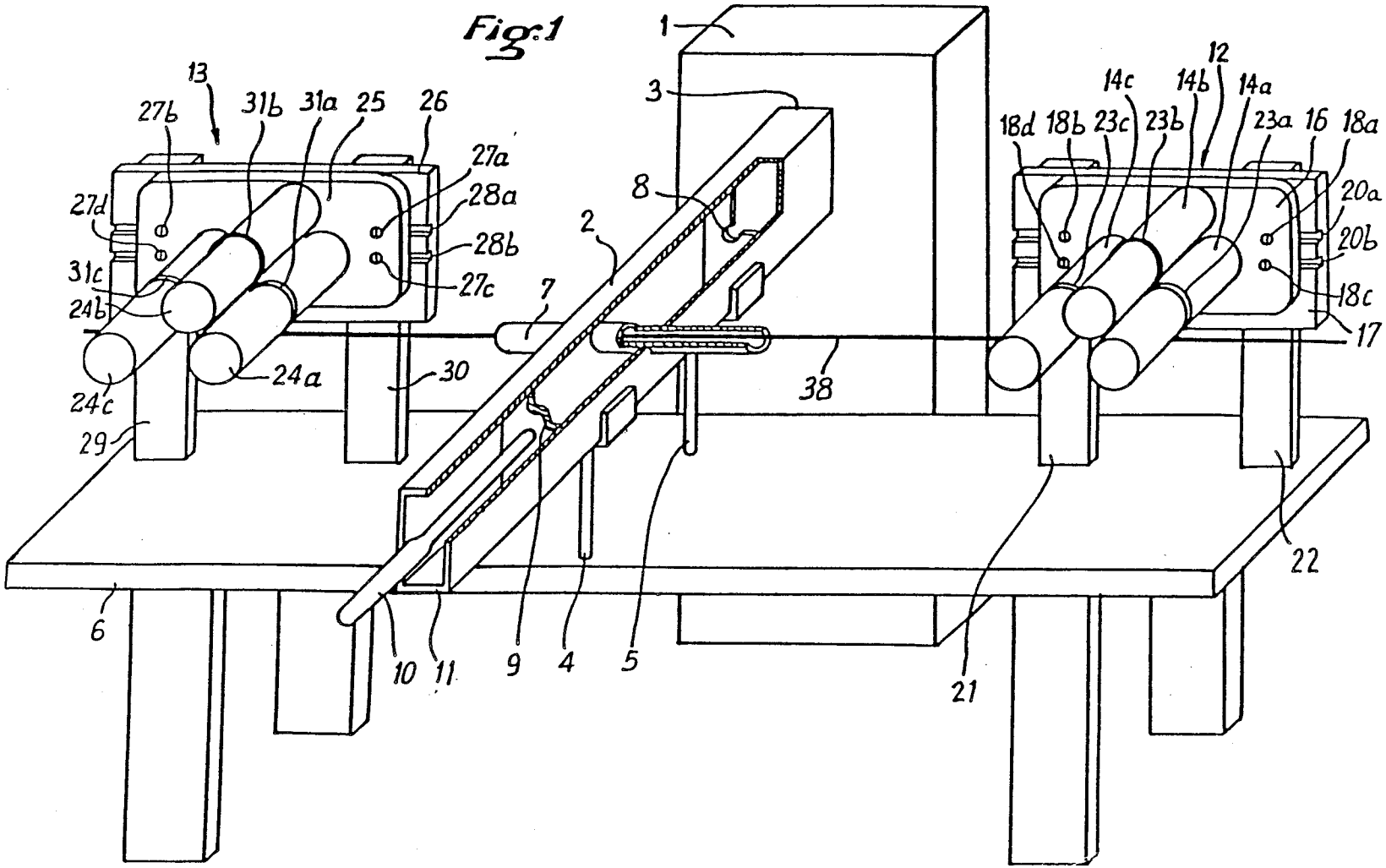

METHOD AND DEVICE FOR THE THERMAL TREATMENT OF A CONDUCTOR ELEMENT AT LEAST PARTIALLY CONSTITUTED BY A CONDUCTING MATERIAL

The invention concerns a method and a device for the thermal treatment by Joule effect of a conductor element at least partially constituted by a conducting material.

The method and device according to the invention are in particular adequate for heating a conductor element of the above mentioned type, advantageously in a filiform shape and specially in the shape of fibers, which carries a continuous or discontinuous coating of a material, specially based on a polymeric product susceptible to become heated by thermal conduction and for that reason to soften or harden, depending on whether said material is thermoplastic or thermosetting, to form a homogeneous coating of the conductor element.

It is known that any electric conductor having an ohmic resistance is the seat of a heating by Joule effect when it is traversed by an electric current.

The use of a direct electric current for heating a conductor and specially an advancing conductor is well known and gives satisfactory results provided that the contact resistances at the inlet point of energy be very weak in relation to the resistance of the conductor.

When the conductor carries a thermofusible or thermosetting coating of insulating nature such as a coating obtained by deposit of a powdered polymeric material, the presence of said coating interferes with the conditions of good contact. For this reason it is no longer possible to carry out a satisfactory fusion or setting of such a coating by passing a direct electric current into the conductor carrying said coating for obtaining a homogeneous coating of said conductor by the thermofusible or thermosetting coating material.

There has been described already (French No. A-1569046) continuously heating a dielectric material covering a filiform element conductor of electricity by means of microwaves by having recourse to a device including a coaxial conductor comprising a conducting covering closed at both ends by conducting elements and two tubular conducting cores aligned and separated from each other by a predetermined space, which are fixedly situated in the interior of the covering and coaxially to the latter. The heating is carried out by making the filiform element covered with dielectric material circulate in the interior of said two tubular cores and by subjecting said dielectric material in the space separating the two conducting cores to the action of an electric field created by microwaves produced in the coaxial conductor by transfer to the latter, by means of an electronic adapter, of the microwave electromagnetic energy delivered by a generator.

The above mentioned heating by microwaves, which is a heating of the type by dielectric losses, cannot be practiced other than with filiform conducting elements due to the necessity of making these elements pass to the interior of the coaxial conductor. Besides, said heating can only be carried out for coating materials of the filiform conductor element having dielectric losses at the frequencies used.

It has likewise been proposed (German No. A-1916870) to heat by microwave a metal conductor coated or not with a dielectric material by making the conductor pass into the interior of a conducting external cover advantageously provided with two short circuits capable to short circuit the metal conductor and the conducting external cover so as to form a coaxial line of leakages alongg which propagates the microwave electromagnetic energy transferred to the line from a generator by means of a coupling system of the wave guide type. The coaxial line leaks since, the microwave energy dissipates by Joule effect in the conductor and equally by dielectric leakages in the coating material of the conductor, in the coating material of the conducting external cover, and eventually in the area where the coaxial line is situated.

Such a mode of heating of metal conductor has certain inconveniences. In the first place, the mode of transmission to be selected for transporting the energy depends on the dimensions of the system, which changes the polarization of the field inside the coaxial line. Besides, there is interaction of the field inside the coaxial line with the area in which the line is situated, which consumes a large portion of the energy and attenuates the Joule effect. In addition, although the system constitutes a resonator in the sense of a return of the energy by the short circuit, the latter mainly serving to close the system to prevent the interference of the environment, said resonator is not keyed in frequency to the generator and does not behave like a real resonant system where the overcurrents are intense. Finally, this mode of heating using the transportation of microwave electromagnetic energy in a coaxial line of leakages, cannot be applied to non-filiform products and particularly to flat conducting elements such as sheets.

It has been found that it was possible, by using a high-frequency alternating current in a particular application, to ensure the heating of a conductor element by Joule effect under satisfactory conditions, which allow, specially when said conductor elements carry a continuous or discontinuous coating of a thermofusible or thermosetting insulating material, to ensure by thermal conduction a fusion or setting of said conducting material to a homogeneous coating of the conductor element. Such a practice makes it possible to overcome the inconveniences and insufficiencies of the above mentioned techniques of heating conductor elements.

Therefore, the object of the invention is a method of thermal treatment of a conductor element constituted, at least partially, by an electrically conducting material in which there is coupled to a portion of the conductor element an electromagnetic energy emitted by an electromagnetic source so as to generate in this portion of conductor element an alternating current of a frequency comprised between 1 MHz and 10 GHz and said electric current is blocked in the portion of the conductor element in which it has been generated, which produces a heating of said portion of the conductor element by Joule effect, characterized by carrying out the coupling of the electromagnetic energy to the portion of conductor element by making the latter play the part of an antenna tuned on the emission frequency of the source of electromagnetic energy.

The blocking of the alternating electric current of a frequency comprised between 1 MHz and 10 GHz in the portion of the conductor element that plays the part of antenna is carried out in particular by limiting said portion of the conductor element by two short circuits.

The method according to the invention can be applied to an immobile conductor element or to a conductor element that continuously moves in the course of the treatment. Said method is very specially convenient for the thermal treatment of conductor elements that advance at high speed.

The alternating electric current circulating in the portion of the conductor element that plays the part of antenna is induced by electrically or magnetically coupling to said portion of the conductor element the energy created by the source of electromagnetic energy emitting at the chosen frequency comprised between 1 MHz and 10 GHz.

The length of the portion of the conductor element that plays the part of antenna traversed by the alternating current of a frequency comprised in the above cited range is advantageously chosen for constituting a circuit of resonance by leakage the frequency of resonance of which corresponds to the frequency of emission of the electromagnetic source.

When the portion of the conductor element traversed by the alternating current is delimited by two short circuits, said short circuits can be of the capacitive type or also of the inductive type.

The conductor element subjected to the treatment according to the invention can have any shape whatever. It can have specially the shape of a plate, of a foil, or of a sheet, or also, advantageously, the shape of a filiform element, that is, of a supple or rigid fine element of great length having the shape of a thread or of a tape. The filiform element can have specially the shape of a monofilamentary or multifilamentary thread, of a fiber thread, or also of a strand.

The conductor element is generally wholly constituted by a conducting material such as metal, carbon, graphite, a mixture of said materials, but there can be conceived the case where the conductor element is formed only in part of conducting material the other part consisting of a practically non-conducting material specially of the inorganic type like silica.

The method according to the invention is particularly adequate for the thermal treatment of conductor elements wholly consisting of carbon fibers or having only one part formed of carbon fibers, the other part being constituted by a carbon free material and in particular by carbon free fibers like glass fibers. When the conductor element is formed only in part of carbon fibers, it comprises advantageously at least 10% by weight of said fibers while the remaining part is constituted by carbon free material. A conductor element of this type can be formed, for example, of from 20 to 40% by weight of carbon fibers and from 80 to 60% by weight of glass fibers.

The conductor element treated by the method of the invention can carry a continuous or discontinuous coating of a material susceptible of becoming heated by thermal conduction and of fusing or setting for ensuring a homogeneous cover of the conductor element.

The continuous or discontinuous coating of material susceptible of becoming heated by thermal conduction that the conductor element can carry can be formed by any method known and, for example, by spraying a solution of said material on the conductor element, by passing the conductor element into a bath constituted by a solution of the coating material, or also by electrostatic or non-electrostatic dusting of the conductor element in a fluid bed of a powder of said coating material.

The coating material susceptible of becoming heated by thermal conduction can consist of a thermoplastic material and specially of a thermoplastic polymer such as polyamide, as, for example, polyamide 11, polyamide 12, or polyamide 6, polyolefin and specially polyethylene or polypropylene, polycarbonate, polytetrafluoroethylene, vinylidene polyfluoride, or also of a thermosettable material and in particular of a thermosettable resin, as, for example, an epoxy resin.

The conductor element, which can have any shape and specially one of the above indicated shapes, can likewise consist of an armature, conductive or not, immersed in a matrix constituted of a mixture of a thermoplastic or thermosetting material susceptible of becoming heated by conduction and of a conducting material. Said thermoplastic or thermosetting material and the conductor material are such as defined above, while the armature can specially consist of threads, fibers, lattices, woven or not, of a material wholly or only partly constituted by a conductor material, as mentioned above.

If necessary, the thermal treatment of the conductor element can be carried out in controlled atmosphere and specially in inert atmosphere, for example, nitrogen atmosphere or atmosphere of rare gases.

A device for putting into practice the method according to the invention, that is, for the thermal treatment of a conductor element constituted, at least partly, by an electrically conducting material, includes a generator of electromagnetic energy susceptible of emitting electromagnetic waves with a frequency comprised between 1 MHz and 10 GHz, an applicator system arranged for coupling to a portion of the conductor element the electromagnetic energy emitted by the generator so as to produce in said portion of conductor element an electric current of the same frequency as the waves emitted by the generator, and a short-circuit system arranged for blocking in the portion of conductor element the electric current produced in said portion of conductor element, and it is characterized by the fact that said portion of conductor element is disposed so as to constitute an antenna coupled to the generator by means of the applicator system and said short-circuit system is of the inductive or capacitive type and has an arrangement such that the portion of conductor element that forms antenna is either in contact with said system or constitutes the active portion thereof.

The short-circuit system is preferably arranged in a manner such that the portion of conductor element in which it blocks the electric current generated in said portion forms a circuit resonating at the frequency of the waves emitted by the generator so as to create a superintensity in said portion of conductor element.

The generator of electromagnetic energy that forms part of the device according to the invention can be selected among the different existing generators susceptible of emitting electromagnetic waves having a frequency comprised between 1 MHz and 10 GHz. The generator can specially consist of a generator of electromagnetic waves, called microwaves, having frequencies comprised between 0.3 GHz and 10 GHz, such a generator being, for example, a magnetron or also of the electronic oscillator type with a klystron. The generator can also be selected among the generators of electromagnnetic waves called high frequency (HF waves) or very high frequency (VHF waves) having frequencies comprised between 1 HMz and 300 MHz, such generators being, for example, of the electronic oscillator type with a vacuum tube, or with transistors.

The applicator system that allows the coupling to the conductor element of the electromagnetic energy emitted by the generator can be adjusted for effecting a magnetic coupling of said energy. Such an applicator system most frequently includes a winding fed by the generator, said winding being associated with a second winding formed by the conductor element to constitute a transformer in which the winding of the applicator system constitutes the primary winding and the wound conductor element forms the secondary winding. Such an applicator system that requires that the conductor element be in the form of a winding can only be used in the practice in the case of treatment of conductor elements such as metal filiform conductors susceptible of being given the shape of windings of the solenoid type.

Preferably, and in particular in the case of treatment of non-metal conductor elements, the applicator system that allows coupling to the conductor the electromagnetic energy emitted by the generator is arranged for effecting an electric coupling of said energy. When the generator is of the microwave generator type, the applicator system of the electric coupling type can consist of a wave guide fed by the generator, said wave guide being traversed by the conductor element to be treated in parallel with the electric field created in the wave guides. When the generator is of the high-frequency (HF) or very high-frequency type (VHF), the applicator system of the electric coupling type can consist of an antenna excited by the generator, the conductor element playing the part of receiver antenna. The emitting antenna can be of any type known in the art and can consist, for example, of a semicylindrical baffle plate of a metal such as aluminum or also of a cylindrical or semicylindrical bar of a metal such as copper or aluminum.

The applicator system, and in particular the applicator system of the electric coupling type, includes adaptation means to impedance which ensure an optimal coupling to the conductor element of the electromagnetic energy produced by the generator. In an applicator including a wave guide, the means of adaptation to impedance comprise a coupling iris and a short-circuit piston of variable position disposed in the wave guide between the generator and the passage zone of the conductor element for the coupling iris and below said passage zone for the piston of variable short circuit. In an applicator of the emitting antenna type, the means of adaptation to impedance consist, among others, of means appropriate for causing the distance of the antenna to the conductor element to change.

The short-circuit system that makes it possible to block in a portion of the conductor element the electric current induced in said conductor element can be a short-circuit system of the inductance type. Such a short-circuit system can be constituted by the conductor element itself put in the form of a winding having a diameter and length adequate for imparting to said winding of self-induction coefficient having a value sufficient for the current induced in the wound conductor element to be blocked in the winding by solenoid effect.

A short-circuit system of the capacitive type is generally preferred, specially when the conductor element cannot be put in the form of a winding. Such a short-circuit system of the capacitive type comprises two short circuits of capacitive type of weak impedance which are disposed on both sides of the applicator system and are each connected by contact to the conductor element so as to define between them a portion of the conductor element in which must be blocked the electric current of high frequency induced by the applicator system in this portion of the conductor element.

According to an advantageous embodiment, each one of the two short circuits of the capacitive type includes a contact element on which is supported the conductor element, said contact element being secured to a support that plays the part of earth and being separated from said support by an appropriate clearance to form a capacity of weak impedance adequate to ensure a capacitive return of the high-frequency electric current to the earth. In particular each one of the two short circuits of the capacitive type can be constituted by one or several rollers on each one of which is supported the conductor element, each one of said rollers including a longitudinal axle around which it is rotatably movable, being fastened by said axle to a supporting plate that plays the part of earth, said fastening being made so as to create a slight play between the rollers and the supporting plate to obtain a capacity having a very weak impedance value adequate for ensuring a return to the earth of the current induced in the portion of the conductor element defined by the two short circuits.

The short circuits of the capacitive type including one or several rollers can be advantageously used when the conductor element is a supple conductor element and in particular a filiform supple conductor element susceptible of resting on the rollers by assuming the form of one portion of the contour of the latter, which allows ensuring a good contact between the roller and the conductor element.

The two short circuits of the short-circuit system of capacitive type are mounted in a manner such that they can be displaced one in relation to the other for increasing or reducing the distance that separates them and thus to make it possible to change the length of the portion of conductor element that they define.

The conductor element in contact with each one of the two short circuits of capactive type that include or do not include rollers can be driven with a movement of continuous progression and in this case the device according to the invention additionally includes driving means arranged to ensure said progressive movement.

Figure 2:
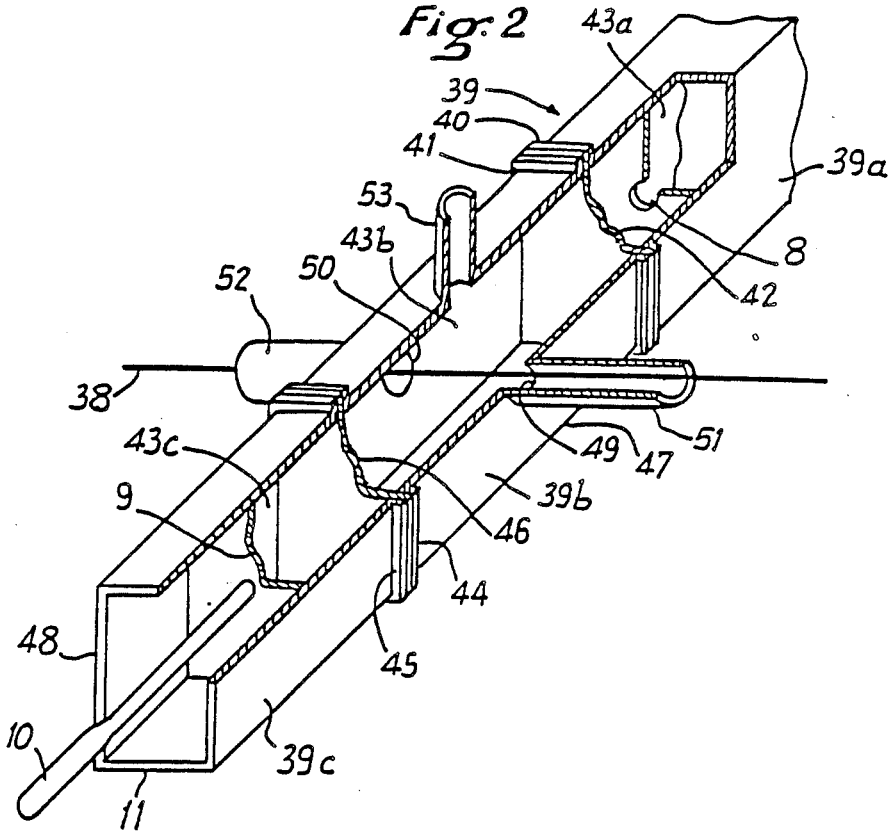
Figure 1A:
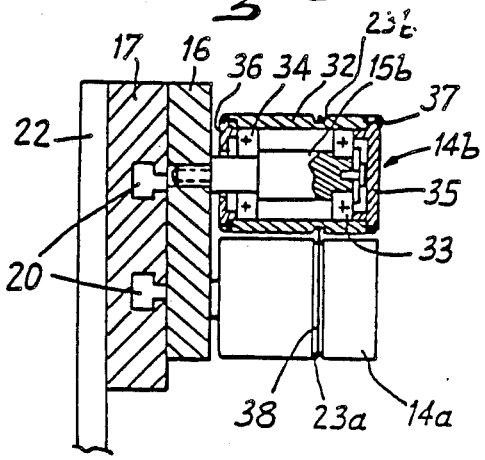
Figure 1B:
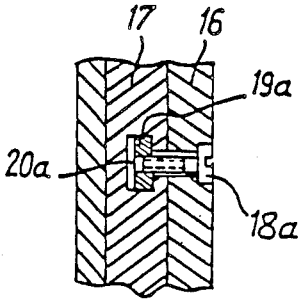
Figure 3:
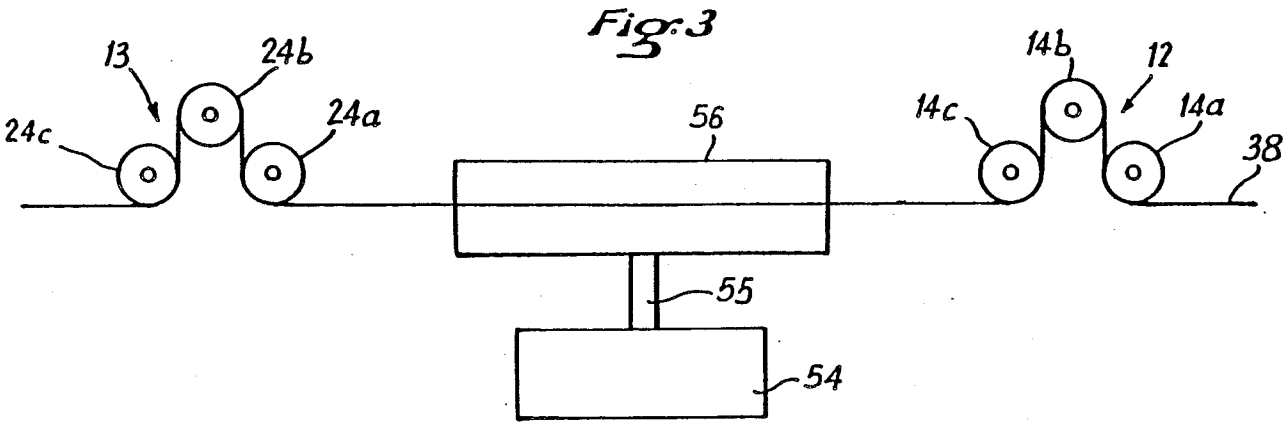
Figure 3A:
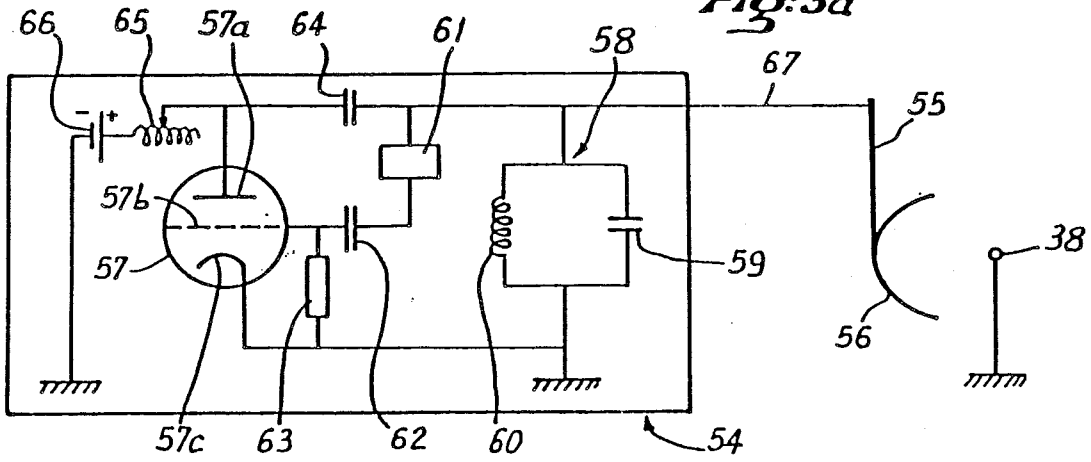

Other advantages and characteristics of the invention will become apparent when reading the description that follows of two of its embodiments illustrated by the appended drawing, wherein:

FIG. 1 diagrammatically shows a device according to the invention of the microwave type including an applicator with wave guides and a short-circuit system of the capacitive type with rollers, while FIG. 1*a* shows in cross section by a plane passing by the axle of one roller one of the short circuits of the short-circuit system mounted on the device of FIG. 1 and FIG. 1*b* diagrammatically shows in cross section a detail of the fastening of the short-ciruit system;

FIG. 2 gives a variant of the structure of the applicator system with wave guide, and FIG. 3 shows in diagram a device according to the invention including a high-frequency transmitter (HF), an antenna used as applicator system and a short-circuit system with rollers, while FIG. 3*a* shows in diagram the transmitter HF and the connection thereof with the antenna.

Referring to FIGS. 1, 1*a* and 1*b*, the device shown includes a generator 1 of microwave, specially a magnetron generator emitting electromagnetic waves with a frequency, for example, of 2.45 GHz. A wave guide 2, which has a rectangular section in which the largest dimension is vertical, is connected by its end 3 to the generator 1 and rests by its crutches 4 and 5 on a frame 6. This wave guide is traversed in its central portion by a quartz hollow cylinder 7 the longitudinal axis of which is horizontal and orthogonally meets the longitudinal axis of the wave guide, this latter axis corresponding to the axis of wave propagation in said wave guide. A coupling iris 8 of adjustable aperture is mounted in the wave guide between the end 3 of the wave guide near the generator 1 and the hollow cylinder 7, the plane of the iris being perpendicular to the longitudinal axis of said wave guide, while a short-circuit piston 9 that can be adjustably positioned, provided with an operating rod 10 obtures the wave guide between the hollow cylinder 7 and the end 11 of the wave guide 2 more remote from the generator. A first short circuit 12 and a second short circuit 13 of identical structure are disposed at both sides of the wave guide and form the short-circuit system. The short circuit 12 includes three cylindrical rollers, respectively 14*a*, 14*b* and 14*c*, each one mounted with free rotation on an axis such as the axis 15*b* for the roller 14*b*, said axis being orthogonal to the longitudinal axis of the hollow cylinder 7 and being secured to a plate that plays the part of earth. The plate 16 is mounted on a support 17 by means of four screws, namely, 18*a*, 18*b*, 18*c* and 18*d*, which are screwed in an associated piece forming a screw nut, for example, 19*a* associated to the screw 18*a* and susceptible of sliding in one of the two T-shaped grooves 20*a* and 20*b* on the surface of support face 17 opposite to the plate 16. More particularly the screw nut pieces 19*a* and 19*b* associated to the screws 18*a* and 18*b* can slide in the groove 20*a* while the screw nut pieces 19*c* and 19*d* associated with the screws 18*c* and 18*d* can slide in the groove 20*b*. The support 17 is integral with two support elements 21 and 22 themselves fastened to the frame 6. The rollers 14*a*, 14*b*, and 14*c* which are each provided with a circumferential groove 23*a*, 23*b* and 23*c*, respectively, on their external sidewall are disposed above the longitudinal axis of the hollow cylinder 7 in a manner such that this axis is substantially tangent to the rollers 14*a* and 14*c* and that on one hand the separation between the rollers 14*a* and 14*c* is substantially equal to the diameter of the roller 14*b* to the plane tangent to the rollers 14*a* and 14*c* and containing the axis of the hollow cylinder 7 is about 1.5 times the diameter of the rollers.

The short circuit 13 likewise includes three cylindrical rollers, respectively 24*a*, 24*b* and 24*c*, which are identical with the rollers of the short circuit 12 and are each mounted free for rotation on an axis having a direction orthogonal to the longitudinal axis of the hollow cylinder 7, said axis being secured, as indicated above for the short circuit 12, to a plate 25 playing the part of earth. The plate is mounted on a support 26 by means of four screws, namely, 27*a*, 27*b*, 27*c* and 27*d*, each one of which is screwed on an associated piece forming a screw nut analogous to the pieces 19*a* associated to the screw 18*a* in the short circuit 12 and capable of sliding in pairs in one of the two T-shaped grooves 28*a* and 28*b* on the surface of the support 26 opposite to the plate 25. More particularly the pieces forming nut screws associated with screws 27*a* and 27*b* can slide in the groove 28*a* while the pieces forming nut screws associated with the screws 27*c* and 27*d* can slide in the groove 28*b*. The support 26 is integral with two support elements 29 and 30 themselves secured to the frames 6.

The rollers 24*a*, 24*b* and 24*c* which are each provided with a circumferential groove 31*a*, 31*b* and 31*c*, respectively, on their external sidewall are disposed above the longitudinal axis of the hollow cylinder 7 in a manner such that said axis is substantially tangent to the rollers 24*a* and 24*c* and that, on one hand, the separation between the rollers 24*a* and 24*c* is substantially equal to the diameter of the roller 24*b* and, on the other hand, the distance of the longitudinal axis of the roller 24*b* to the plane tangent to the rollers 24*a* and 24*c* and containing the axis of the hollow cylinder 7 equal to about 1.5 times the diameter of the rollers.

The different rollers of the short circuits 12 and 13 have an identical structure, namely, the one shown in section on FIG. 1*a* in the case of the roller 14*b*. The roller 14*b* includes a cylindrical sleeve 32 having a circumferential groove 23*b* on its external surface and supported by two ball bearings, respectively 33 and 34, mounted on the axis 15*b* of the roller, said axis being secured by screwing to the plate 16. Two side plates 35 and 36 secured to the sleeve by screws such as 37 close the ends of the sleeve and form likewise stops for the ball bearings 33 and 34. The side plate 36 of each roller, which is opposite to the plate playing the part of earth, that is, plate 16 for the roller 14*b*, is separated from said plate by a slight clearance in a manner such that the plate-roller combination forms a capacity.

The conductor element 38 to be treated, which is shown here in supple, filiform shape, comes into contact with the short circuit 12 by leaning against the portion turned to the bottom of the groove 23*a* of the roller 14*a*, then winding on the portion turned to the top of the groove 23*b* of the roller 14*b* and finally leaning against the portion turned to the bottom of the groove 23*c* of the roller 14*c*. Then it passes through the hollow cylinder 7 and thereafter comes into contact with the short circuit 13 by leaning against the portion turned to the bottom of the groove 31*a* of the roller 24*a*, then winding against the portion turned to the top of the groove 31*b* of the roller 24*b* and finally leaning against the portion turned to the bottom of the groove 31*c* of the roller 34*c*. At its exit of the short circuit 13, the conductor element is taken up by traction means, and wound, for example, on a winder, not shown, driven in rotation by a motor, which ensures a continuous progression of the conductor element through the device.

The wave guide 2 that equips the device diagrammatically shown in FIG. 1 can be replaced by a dismountable wave guide 39 such as shown in FIG. 2. Said wave guide 39, which likewise has a rectangular section of which the largest dimension is vertical, includes three parts, namely, a front part 39*a*, a central part 39*b* and a rear part 39*c*. The front part 39*a* and central part 39*b* of the wave guide have their ends respectively facing 40 and 41 in the form of collars and are tightly connected by mechanical fastening means such as bolts not shown that support said collars aginst each other. A window 42 of a material pervious to electromagnetic waves such as TEFLON ® is interposed between the collars 40 and 41 and separates the internal zone 43*a* of the front part 39*a* of the wave guide from the internal zone 43*b* of the central part 39*b* of said wave guide. The central part 39*b* and the rear part 39*c* of the wave guide have likewise their ends respectively opposite at 44 and 45 in the form of collars and are tightly connected by mechanical fastening means such as bolts not shown supporting said collars against each other. A window 46 of a material of the same nature as that of the window 42 is interposed between the collars 44 and 45 and separates the internal zone 43*b* of the central part 39*b* of the wave guide from the internal zone 43*c* of the rear part 39*c* of said wave guide. A coupling iris 8 is mounted in the front part 39*a* of the wave guide while a short-circuit piston 9 of adjustable position provided with an operating rod 10 obtures the rear part 39*c* of said wave guide. Each one of the large faces 47 and 48 of the wave guide has at the level of the central part 39*b* of the latter a circular orifice, respectively 49 and 50, extended by a cylindrical hollow tip, respectively 51 and 52, the longitudinal axes of said tips being blended and orthogonally meeting the longitudinal axis of the wave guide. In addition the internal zone 43*b* of the central part 39*b* of the wave guide opens toward the outside by a cylindrical outlet pipe 53, said outlet pipe being arranged to be connectable to a source of inert gas under slight pressure so as to allow a sweeping of the internal zone 43*b* of the central part 39*b* of the wave guide by an inert gas.

The device that has been described with reference to FIGS. 1, 1*a*, 1*b* and 2 operates as follows. The filiform conductor element 38 which can, for example, originate from a supply system of the feed-spool type or also from an installation where the conductor element has undergone a previous treatment such as a coating by dusting or coating, passes first into contact with the rollers 14*a*, 14*b* and 14*c* of the capacitive short circuit 12, as described above, then axially traverses the hollow cylinder 7 associated with the wave guide 2 or the tip 51, the zone 43*b* and the tip 52 of the wave guide 39, then comes into contact with the rollers 24*a*, 24*b* and 24*c* of the capacitive short circuit 13, as indicated before, and finally winds on a winding mechanism driven to rotate at a constant speed, for example, from a few centimeters to a few meters per second, by a motor. The rotation of the winding mechanism ensures the driving of the conductor element and for the same reason its continuous progression through the device of thermal treatment.

Prior to starting the thermal treatment of the conductor element 38, there is effected an adaptation of impedance and of frequency of the applicator system, namely, wave guide 2 and hollow cylinder 7 or wave guide 39 and hollow tips 51 and 52, by acting on the opening of the coupling iris 8 and the positioning of the piston 9 in the wave guide in a manner such that the electromagnetic energy supplied with the microwave generator 1 is wholly transferred to the conductor element 38. As it is well known, such an adaptation of impedance and of frequency is effected by measurement a frequency wobbler.

The generator 1 such as with magnetron emits electromagnetic waves of the microwave type having a frequency comprised between 0.3 GHz and 10 GHz and propagating in the wave guide 2 or 39. In the range of frequency of emitted waves, said waves spread in the wave guide 2 or 39 of rectangular section of large vertical dimension, according to the mode $TE_{01}$. In such a mode of propagation the electric field associated with the microwaves is maximum in a central plane perpendicular to two large faces of the wave guide, that is, parallel with the longitudinal axis of the hollow cylinder 7 associated with the wave guide 2 or with the longitudinal axis of the tips 51 and 52 associated with the wave guide 39, said axis representing the axis of progression of the filiform conductor element 38.

Therefore, the portion of conductor element 38 defined by the two short circuits 12 and 13 is situated parallel with the electric field associated with the microwaves that propagate in the wave guide in a zone where said electric field is maximum, which entails an electric coupling of the electromagnetic energy of the microwaves to the aforementioned portion of the conductor element 38, which plays the part of an antenna tuned on the emission frequency of the generator 1 having as result the induction of a microwave electric current in said portion of the conductor element, this electric current being brought back to the earth by the capacitive short circuits 12 and 13. Such a return to the earth by the short circuits 12 and 13 prevents a propagation of the microwave current, on the one hand, up to the winding mechanism receiving the conductor element thermally treated and, on the other hand, up to the means for supplying the conductor element to the device of thermal treatment.

The distance between the short circuits 12 and 13 which determines the length of the portion of conductor element traversed by the microwave electric current is adjusted so that said portion constitutes a resonant circuit at the frequency of the waves emitted by the generator, which makes it possible to obtain a superintensity in this portion of the conductor element.

The portion of conductor element defined by the two short circuits 12 and 13 and in which the microwave electric current circulates is heated by Joule effect and therefore can be brought to the temperature required for the thermal treatment of the conductor element, a temperature that depends, among other factors, on the energy supplied by the generator to the conductor element.

When the conductor element consists of a conducting material such as carbon fibers or also metal carrying a continuous or discontinuous coating of a material capable of becoming heated by thermal conduction and either melting or also setting, the heating of the conductor material by Joule effect involves a heating by conduction of the coating material so that as it melts, in case of a thermoplastic material, or sets, in case of a thermosetting material, to form a compact and homogeneous covering of the conductor element.

Thus, by treating by the method according to the invention applied in a device analogous to that of FIG. 1 and having a generator with a magnetron that emits micro waves having a frequency of 2.45 GHz, a filiform conductor element 38 consisting of a tape of carbon fibers coated by an electrostatic dusting process in a fluid bed of a polyamide powder, there has been obtained a compact and homogeneous covering of the carbon fibers of the tape by fusion by thermal conduction of the polyamide powder under the action of the heating by Joule effect of the carbon fibers traversed by the microwave electric current. According to the tests, the power supplied by the generator to the conductor element was comprised between 500 W and 2000 W and the speed of the conductor element was between 0.1 and 1.5 m/s.

The device diagrammatically shown in FIGS. 3 and 3*a* comprises a transmitter HF 54, an applicator system consisting of an antenna of a metal such as aluminum or copper connected to the transmitter HF by a conductor 67 and comprised of a supporting bar 55 ending by a semicylindrical baffle plate 56 and a short-circuit system including a first short circuit 12 and a second short circuit 13. Instead of the antenna with semicylindrical baffle plate, there may be equally used an antenna consisting only of a copper or aluminum bar of cylindrical or semicylindrical section. The short circuits of the short-circuit system have a structure analogous to that of the short circuits shown in FIGS. 1, 1*a* and 1*b* and include, therefore, three rollers 14*a*, 14*b* and 14*c* for the short circuit 12 and three rollers 24*a*, 24*b* and 24*c* for the short circuit 13, each one of the rollers likewise carrying a groove on its external side surface, said short circuits 12 and 13 being situated on both sides of the antenna.

The conductor element 38 to be thermally treated and which is shown here in a supple filiform shape, comes into contact with the short circuit 12 by leaning against the grooves of the rollers 14*a*, 14*b* and 14*c*, as indicated in the case of the device of FIG. 1, then it passes before the reflector 56 of the antenna in a direction parallel with the longitudinal axis of said reflector and then comes into contact with the short circuit 13 by leaning against the grooves of the rollers 24*a*, 24*b* and 24*c*, as indicated for the device of FIG. 1. At its exit from the short circuit 13, the conductor element 38 is taken up by receiving means, for example, is wound on a winding mechanism not shown driven to rotate by a motor, which ensures a continous progress of the conductor element through the device.

The generator HF 54 of electromagnetic energy includes an amplifier tube in vacuum of the triode type 57 which has an anode 57*a*, a grill 57*b* and a cathode 57*c*, and in which the anode charge is a resonant circuit 58 including in parallel a capacity 59 and an inductor 60. A divider/inverter circuit 61 removes and inverts a fraction of the oscillations of anodic tension and injects the fraction of the inverted oscillations on the grid 57*b* of the triode 57 through a capacity 62 preventing the passage of any continuous component of said fraction. A resistance 63 is interposed between the grid 57*b* and the earth. The anode 57*a* is connected to the positive terminal of a high-tension supply 66 through a winding 65 of adjustable inductance that prevents the tension oscillations from rising to the continuous supply 66 while a capacity 64 prevents the passage of any continuous component toward the oscillating circuit.

The operation of the device with generator HF of electromagnetic energy and an applicator system of the antenna type diagrammatically shown in FIGS. 3 and 3*a* is similar to that of the device that uses microwaves diagrammatically shown in FIGS. 1, 1*a*, 1*b* and 2.

The filiform conductor element 38 which can, for example, come from a supply system of the feed-spool type or also from an installation where the conductor element has undergone a previous treatment such as a coating by dusting or coating, comes first into contact with the rollers 14*a*, 14*b* and 14*c* of the short circuit 12, then advances before the reflector 56 of the antenna so as to be contained in the plane of symmetry of the reflector that passes by the longitudinal axis of the latter, and to lean parallel with said longitudinal axis. It then comes into contact with the rollers 24*a*, 24*b* and 24*c* of the short circuit 13 and finally winds on a winding mechanism put in rotation at constant speed, for example, a few centimeters to a few meters per second, by a motor. The rotation of the winding mechanism ensures the driving of the conductor element and for the same reason its continuous progress through the device of thermal treatment. The coming of the conductor element 38 into contact with the rollers of the short circuit 12 and into contact with the rollers of the short circuit 13 takes place as indicated before in the case of the device of FIG. 1.

Prior to carrying out the thermal treatment of the conductor element 38, there is effected an adaptation of impedance of the applicator system, namely, antenna, by changing the distance that separates the conductor element 38 from the reflector 56 of the antenna so as to bring to a maximum the transfer of energy of the generator HF 54 to the conductor element 38.

The generator HF 54 produces oscillations having a frequency comprised between 1 MHz and 0.3 GHz, which excite the antenna and cause it to radiate electromagnetic waves having a frequency corresponding to that of the oscillations produced by the generator 54.

The portion of conductor element 38 defined by the two short circuits 12 and 13, which has a direction parallel with that of the longitudinal axis of the baffle plate 56 of the antenna, behaves like a receiving antenna and picks up the electromagnetic waves emitted by the antenna having as result the production of an electric current of high frequency in said portion of the conductor element 38, said electric current being returned to the earth by the capactive short circuits 12 and 13.

The same as for the device of FIG. 1, the distance between the short circuits 12 and 13 that determines the length of the portion of conductor element traversed by the high-frequency electric current is adjusted so that said portion of the conductor element constitutes a resonant circuit at the frequency of the oscillations emitted by the generator HF 54.

The portion of conductor element defined by the two short circuits 12 and 13 and in which the high-frequency electric current circulates, is heated by Joule effect and therefore can be brought to the temperature required for the thermal treatment of the conductor element.

When the conductor element consists of a conducting material such as non-metallic conducting fibers like carbon or also metal fibers carrying a continuous or discontinuous coating of a material capable of becoming heated by thermal conduction and either to melt or to set, the heating of the conducting material by Joule effect involves, as indicated before in the case of the operation of the device according to FIG. 1, a heating by conduction of the coating material, which, depending on the case, melts if it is thermoplastic or sets if it is thermosetting to form a compact and homogeneous covering of the conductor element.

Thus, when treating by the process of the invention, carried out in a device analogous to that of FIGS. 3 and 3*a* and having a generator HF emitting at a frequency of 27.12 MHz, a filiform conductor element consisting of a tape of carbon fibers coated by an electromagnetic dusting process in fluid bed with a polyamide powder, there has been obtained a compact and homogeneous covering of the tape of carbon fibers by fusion by thermal conduction of the polyamide powder under the action of the heating byy Joule effect of the carbon fibers traversed by the high-frequency electric current. For the tests performed the distance from the conductor element 38 to the support 55 of the antenna was equal to 10 cm while the distance between the short circuits 12 and 13 was of 2 meters. Besides, according to the tests, the power supplied to the conductor element 38 changed from 530 W to 2100 W and the speed of progress of the conductor element went from 0.15 m to 1.2 m per second.

It is to be understood that the invention is not confined to the embodiments described and shown, but on the contrary covers the different variants accessible to those skilled in the art while remaining within the scope of the invention.

In particular in the device of FIGS. 3 and 3*a*, the portion of conductor element opposite the antenna can advance to the interior of a tube of a material pervious to the electromagnetic waves, and specially of quartz within which prevails a slight overpressure of an inert gas.

What is claimed is:

1. A method for the thermal treatment of a conductor element constituted, at least partially, of an electrically conducting material, which comprises the steps of:

(1) causing an electromagnetic source to emit electromagnetic energy in the form of electromagnetic waves having a frequency comprised between 1 MHz and 10 GHz;

(2) coupling said emitted electromagnetic energy to a portion of the conductor element which is made to act as an antenna tuned on the frequency of emission of the electromagnetic source, so as to generate in said portion of the conductor element an alternating electric current of a frequency between 1 MHz and 10 GHz; and (3) preventing said electric current from circulating in the conductor element outside the portion of the conductor element in which it has been generated, whereby said portion of the conductor element is heated by Joule effect.

2. A method according to claim 1, wherein the electric current that circulates in the portion of the conductor element acting as an antenna is generated by magnetically coupling to said portion of the conductor element the energy emitted by the electromagnetic source.

3. A method according to claim 1, wherein said electric current that circulates in the portion of the conductor element acting as an antenna is generated by electrically coupling to said portion of the conductor element the energy emitted by said electromagnetic source.

4. A method according to claim 3, wherein preventing the electric current from circulating in the conductor element outside the portion of the conductor element acting as an antenna is effected by limiting said portion by two short circuits.

5. A method according to claim 4, wherein each one of said short circuits that limit the portion of the conductor element acting as an antenna traversed by the alternating electric circuit is of the capacitive or inductive type.

6. A method according to claim 3, wherein said conductor element continuously moves in the course of the treatment.

7. A method according to claim 1, wherein said portion of the conductor element acting as an antenna traversed by said alternating electric current has a length selected to induce in said portion a superintensity phenomenon by resonance.

8. A method according to claim 1, wherein said conductor element is a filiform element or an element in the form of a plate, sheet or foil.

9. A method according to claim 1, wherein said conductor element is comprised, at least partly, of carbon fibers.

10. A method according to claim 1, wherein said conductor element carries a coating of material capable of becoming heated by thermal conduction.

11. A method according to claim 10, wherein said material capable of becoming heated by thermal conduction is a thermoplastic material selected from the group consisting of a polyamide, a polyolefin, a polycarbonate, polytetrafluoroethylene and vinylene fluoride.

12. A method according to claim 10, wherein said material capable of becoming heated by thermal conduction is a thermosetting resin.

13. A method according to claim 1, wherein said conductor element includes an armature immersed in a matrix constituted by a mixture of a thermoplastic or thermosetting material and a conductor material.

14. A method according to claim 1, wherein the thermal treatment of said conductor element is carried out in a controlled atmosphere.

15. A method according to claim 14, wherein said controlled atmosphere is an inert atmosphere.

16. A device for the thermal treatment of a conductor element constituted, at least partially, of an electrically conducting material comprising:

(1) a generator of electromagnetic energy capable of emitting electromagnetic waves of a frequency comprised of between 1 MHz and 10 GHz;

(2) an applicator system adapted to effect an electric coupling of the electromagnetic energy emitted by said generator to a portion of the conductor element, so that said portion of the conductor element is made to act as an antenna coupled to the generator and an alternating electric current of the same frequency as the waves emitted by said generator is produced in said portion of the conductor element; and (3) a capacitive short-circuit system arranged to be in contact with both ends of the portion of the conductor element in which the alternating electric current is generated so as to prevent said current from circulating in the conductor element outside said portion of the conductor element.

17. A device according to claim 16, wherein said short-circuit system is arranged in a manner such that the portion of the conductor element in which the alternating electric current is generated forms a circuit that resonates at the frequency of the waves emitted by the generator.

18. A device according to claim 16, wherein said generator is a generator of electromagnetic waves called microwaves having frequencies between 0.3 GHz and 10 GHz.

19. A device according to claim 18, wherein the applicator system includes a wave guide fed by the generator, said wave guide being traversed by the conductor element to be treated in parallel with the electric field created in said wave guide.

20. A device according to claim 16, wherein said generator of high-frequency or very high-frequency electromagnetic waves has frequencies between 1 MHz and 0.3 GHz.

21. A device according to claim 20, wherein the applicator system includes an emitting antenna excited by the generator, the conductor element acting as a receiving antenna.

22. A device according to claim 16, wherein the applicator system includes means adapted to vary the impedance of said system to ensure an optimal coupling to said portion of the conductor element of the electromagnetic energy produced by the generator.

23. A device according to claim 16, wherein the capacitive short-circuit system includes two capacitive short circuits of low impedance which are located on both sides of the applicator system and are each connected by contact with the conductor element so as to define between them the portion of the conductor element in which the alternating current of high frequency is generated.

24. A device according to claim 23, wherein each one of said two short circuits of the capacitive type includes a contact element on which is supported said conductor element, said contact element being secured to a support acting as earth and being separated from said support by a clearance adequate for forming a capacity of weak impedance suited to ensure a capacitive return to the earth of the high-frequency electric current circulating in the portion of conductor element defined by said two short circuits.

25. A device according to claim 23, wherein each one of said two capacitive short circuits is constituted by one or several rollers on which is supported said conductor element, each one of said rollers including a longitudinal axle around which it is rotatably moved and being fastened by said axle to a support plate acting as earth, said fastening being effected so as to obtain an appropriate clearance between said rollers and said support plate for achieving a capacity of sufficiently weak impedance for ensuring a capacitive return to the earth of the high-frequency current induced in said portion of conductor element defined by said two short circuits.

26. A device according to claim 23, wherein the two capacitive short circuits of the capactive short-circuit system are mounted so as to be displaceable in relation to each other for increasing or reducing the distance that separates them.

27. A device according to claim 23, further comprising driving means for continuously moving the conductor element.

28. A device for the thermal treatment of a conductor element constituted, at least partially, of an electrically conducting material comprising a generator of electromagnetic energy capable of emitting electromagnetic waves having a frequency between 1 MHz and 10 GHz, an applicator system adapted to effect a magnetic coupling to the conductor element of the electromagnetic energy emitted by the generator, said applicator system including a winding fed by said generator, said winding being associated with a secondary winding formed by the conductor element to constitute a transformer of which the winding of the applicator system forms the primary winding and the wound conductor element constitutes the secondary winding, in which an alternating current of the same frequency as the waves emitted by the generator is produced, and a short-circuit system adapted to cooperate with said secondary winding at both ends thereof so as to prevent said electric current from circulating in the conductor element outside said secondary winding.

29. A device according to claim 28, wherein said secondary winding forms a circuit that resonates at the frequency of the waves emitted by said generator.

30. A device for the thermal treatment of a conductor element constituted, at least partially, of an electrically conducting material comprising:

(1) a generator of electromagnetic energy capable of emitting electromagnetic waves of a frequency between 1 MHz and 10 GHz;

(2) an applicator system adapted to effect a coupling of the electromagnetic energy emitted by said generator to a portion of the conductor element in such a way that said portion of the conductor element is made to act as an antenna coupled to the generator so as to produce in said portion of the conductor element an alternating electric current of the same frequency as the waves emitted by the generator; and (3) a short-circuit system adapted to cooperate with the portion of the conductor element in which the alternating electric current is generated so as to prevent said electric current from circulating in the conductor element outside said portion.

31. A device according to claim 30, wherein said short-circuit system is arranged in a manner such that the portion of the conductor element in which the alternating electric current is generated forms a circuit that resonates at the frequency of the waves emitted by the generator.

32. A device according to claim 30, wherein said generator is a generator of electromagnetic waves called microwaves having frequencies between 0.3 GHz and 10 GHz.

33. A device according to claim 30, wherein said generator is a generator of high-frequency or very high-frequency electromagnetic waves having frequencies between 1 MHz and 0.3 GHz.

34. A device according to claim 30, wherein the applicator system is adapted to effect an electric coupling of the electromagnetic energy emitted by the generator to the portion of the conductor element.

35. A device according to claim 30, wherein the applicator system is adapted to effect a magnetic coupling of the electromagnetic energy emitted by the generator to the portion of the conductor element.

36. A device according to claim 30, wherein said short-circuit system is of the inductive type and is made of a part of the conductor element itself given the shape of a winding at each end of the portion of the conductor element in which the alternating electric current is generated, said winding having a diameter and a length selected for imparting to said winding a self-inductive coefficient resulting in an impedance of the winding having a value sufficiently high for said alternating current to be prevented from traversing the winding due to the high impedance of said winding.

37. A device according to claim 30, wherein said short-circuit system is of the capacitive type and includes two capacitive short circuits of low impedance which are located on both sides of the applicator system and are each connected by contact with the conductor element so as to define between them the portion of the conductor element in which the alternating current of high frequency is generated.

38. A device according to claim 37, wherein each one of said two capacitive short circuits includes a contact element on which is supported said conductor element, said contact element being secured to a support acting as earth and being separated from said support by a clearance adequate for forming a capacity of weak impedance suited to ensure a capacitive return to the earth of the high-frequency electric current circulating in the portion of conductor element defined by said two short circuits.

39. A device according to claim 37, wherein each one of said two capacitive short circuits is constituted by one or several rollers on which is supported said conductor element, each one of said rollers including a longitudinal axle which is rotatably moved and being fastened by said axle to a support plate acting as earth, said fastening being effected so as to obtain an appropriate clearance between said rollers and said support plate for achieving a capacity of sufficiently weak impedance for ensuring a capacitive return to the earth of the high-frequency current induced in said portion of conductor element defined by said two short circuits.

40. A device according to claim 37, wherein the two capacitive short circuits of the capacitive short-circuit system are mounted so as to be displaceable in relation to each other for increasing or reducing the distance that separates them.

41. A device according to claim 37, further comprising driving means for continuously moving the conductor element.

* * * * *

UNITED STATES PATENT AND TRADEMARK OFFICE

CERTIFICATE OF CORRECTION

PATENT NO. : 4,780,585

DATED : October 25, 1988

INVENTOR(S) : Rochas et al.

It is certified that error appears in the above-identified patent and that said Letters Patent is hereby corrected as shown below:

ON TITLE PAGE:

In the Abstract, lines 13-15: delete "carrying a continuous element, for example based on carbon fibres,"

Col. 2, line 4: "alongg" should be --along--

Col. 4, line 59: "electromagnnetic" should be --electromagnetic--

Col. 5, line 54: "of" should read --a--

Col. 6, line 54: "short-ciruit" should read --short-circuit--

Col. 7, line 43: after "roller 14b" insert --and on the other hand the distance of the longitudinal axis of the roller 14b--

Col. 9, line 46: after "measurement" insert --with--

Col. 11, line 23: "grill" should be --grid--

Col. 12, line 52: "byy" should be --by--

UNITED STATES PATENT AND TRADEMARK OFFICE

CERTIFICATE OF CORRECTION

PATENT NO. : 4,780,585

DATED : October 25, 1988

INVENTOR(S) : Rochas et al.

It is certified that error appears in the above-identified patent and that said Letters Patent is hereby corrected as shown below:

Col. 14, lines 50-53: change Claim 20 to read as follows:

--A device according to claim 16, wherein said generator is a generator of high-frequency electromagnetic waves having frequencies between 1 MHz and 0.3 GHZ."

Signed and Sealed this

Nineteenth Day of November, 1991

*Attest:*

HARRY F. MANBECK, JR.

*Attesting Officer*

*Commissioner of Patents and Trademarks*